US005624285A

United States Patent [19]

Pethieu et al.

[11] Patent Number: 5,624,285

[45] Date of Patent: Apr. 29, 1997

[54] ELECTRICAL CONNECTOR HOUSING ELEMENT

[75] Inventors: Gérard Pethieu, Craches; Jean Ittah, Villeneuve la Garenne; Olivier Plessis, Chaville, all of France

[73] Assignee: Connecteurs Cinch, Societe Anonyme, Montigny le Bretonneux, France

[21] Appl. No.: 514,222

[22] Filed: Aug. 11, 1995

[30] Foreign Application Priority Data

Sep. 15, 1994 [FR] France ..... 94 11034

[51] Int. Cl.[6] ..... H01R 13/436

[52] U.S. Cl. ..... 439/752

[58] Field of Search ..... 439/752, 595

[56] References Cited

U.S. PATENT DOCUMENTS

| | | | |
|---|---|---|---|
| 4,804,341 | 2/1989 | Kato et al. | 439/752 |
| 5,326,287 | 7/1994 | Hamakita et al. | 439/752 |
| 5,478,262 | 12/1995 | Yamanashi et al. | 439/752 |

FOREIGN PATENT DOCUMENTS

| | | |
|---|---|---|
| 3736036 | 2/1989 | Germany . |
| 3840301 | 8/1989 | Germany . |
| 4039239 | 10/1991 | Germany . |
| 2186748 | 8/1987 | United Kingdom . |
| 2229584 | 9/1990 | United Kingdom . |

*Primary Examiner*—Gary F. Paumen
*Assistant Examiner*—T. C. Patel
*Attorney, Agent, or Firm*—Greenblum & Bernstein P.L.C.

[57] ABSTRACT

An electrical connector housing element includes passages each receiving an electrical contact and a system for locking them. The passages are in two series each comprising two rows. The locking system includes two keys in a head-to-tail arrangement and each of which is U-shape with two branches and a core. Each key is mounted so that one of its branches lies between the branches of the other key. Inclined guides are provided in a groove whereby each key can move in the groove in two perpendicular directions. In a locking position the two branches of the first key immobilize the electrical contacts of the two first rows of the two series of passages. In the locking position the two branches of the second key immobilize the electrical contacts of the two second rows of the two series of passages.

20 Claims, 4 Drawing Sheets

ELECTRICAL CONNECTOR HOUSING ELEMENT

BACKGROUND OF THE INVENTION

1. Field of the Invention

The present invention concerns an electrical connector housing element.

The invention is directed to an electrical connector housing element having passages accommodating electrical contact members connected to conductors, said housing element being adapted to be assembled to a complementary housing element comprising electrical contact members adapted to cooperate with the members of said housing element.

2. Description of the Prior Art

One prior art connector housing element includes mobile locking means on said element that can occupy two positions, a first or pre-locking position in which the electrical contact members can be inserted into the corresponding passages and a second or locking position in which it partially closes the passages so that said members cannot move therein.

These locking means usually comprise a mobile bar with notches that align with the passages in the prelocking position and are offset from it in the locking position.

This arrangement is entirely satisfactory if the contact members are relatively large, but cannot be used if they are very small and if the passages are very close together.

The prior art includes German patent 3 840 301 which describes a connector housing comprising a body with passages in which electrical contact members are engaged and a key for locking the latter members in the form of a U-shaped member adapted to occupy a standby position in which the passages are exposed to enable insertion of the contact members and a locking position in which the branches of the U-shape project into the passages to immobilize said contact members.

With an arrangement of this kind the number of passages is necessarily limited.

One object of the present invention is to improve this type of connector so that the number of passages can be very significantly increased substantially without any increase in its overall size.

SUMMARY OF THE INVENTION

The invention consists in an electrical connector housing element comprising an insulative material body having passages each adapted to receive an electrical contact member each of which has a shoulder partway along its length and locking means comprising a U-shape key mobile in a groove of the body perpendicular to the axes of the passages and in two perpendicular directions, said key being adapted to occupy two positions, namely a first or prelocking position in which it enables insertion of the electrical contact members into the passages and a second or locking position in which it cooperates with the shoulders of the electrical contact members to lock the latter in said passages, in which housing element the passages are disposed in two series each comprising two rows and a second U-shape key is provided, the two keys being disposed in a head-to-tail arrangement and each key being mounted in such a manner that one of the branches extends between the branches of the other key, the second key being guided for displacement from the prelocking position to the locking position in two perpendicular directions opposite to the directions of displacement of the first key, the two branches of the first key, in the locking position, immobilizing the electrical contact members of the first two rows of both series of passages, whereas the two branches of the second key, in the locking position, immobilize the electrical contact members of the two second rows of said second series of passages.

Thus, in one aspect of the present invention there is provided an electrical connector housing element comprising an insulative material body having two series of passages, each of the two series of passages comprising two rows of passages including a first row and a second row, the passages comprising longitudinal axes which are positioned substantially parallel to each other, and each of the passages being adapted to receive an electrical contact member, each electrical contact member having a length and comprising a shoulder positioned partway along the length. A groove is positioned in the body, with the groove being perpendicular to the axes of the passages. Still further, two U-shape keys including a first U-shape mobile key and a second U-shape mobile key, each of which includes two branches, are positioned and movable in the groove between a first prelocking position enabling insertion of electrical contact members into the passages, and a second locking position wherein the two keys cooperate with the shoulders of the electrical contact members to lock the electrical contact members in the passages. The two keys are positioned in a head-to-tail arrangement with each key being mounted so that one of the two branches of one of the two keys extends between the two branches of the other of the two keys, with the first key being movable in two perpendicular directions with respect to the axes of the passages, the second key being movable in two perpendicular directions with respect to the axes of said passages, and the two perpendicular directions of movement of the second key being opposite to the two perpendicular directions of movement of the first key, the two branches of the first key, in the locking position, immobilizing the electrical contact members of the first rows of the two series of passages, and the two branches of the second key, in the locking position, immobilizing the electrical contact members of the second rows of the two series of passages.

Still further, in another aspect of the present invention there is provided an electrical connector housing element comprising an insulative material body having passages, the passages comprising longitudinal axes which are positioned substantially parallel to each other, and each of said passages being adapted to receive an electrical contact member, each electrical contact member having a length and comprising a shoulder positioned partway along the length. A groove is positioned in the body, with the groove being perpendicular to the axes of the passages. Additionally, two U-shape keys including a first U-shape mobile key and a second U-shape mobile key, each of which includes two branches, are positioned and movable in the groove between a first prelocking position enabling insertion of electrical contact members into the passages, and a second locking position wherein the two keys cooperate with the shoulders of the electrical contact members to lock the electrical contact members in the passages. The two keys are positioned in a head-to-tail arrangement with each of the two keys being mounted so that one of the two branches of one of the two keys extends between the two branches of the other of the two keys, with the first key being movable in two perpendicular directions with respect to the axes of the passages, the second key being movable in two perpendicular directions with respect to the axes of the passages, and the two perpendicular directions of movement of the second key being opposite to the two perpendicular directions of movement of the first key.

The groove can comprises two edges, with inclined ramps on the two edges, with each of the inclined ramps being inclined in the same direction. Studs can be positioned on each of the two branches of the first key and the second key for cooperating with the inclined ramps to effect movement in one of the two perpendicular directions as each of the two keys is moved in the other of the two perpendicular directions.

Moreover, the element can include at least one boss and at least one recess for cooperating with the at least one boss in the locking position. The at least one boss and the at least one recess can be positioned on at least one of the two edges and on at least one of the two branches of the two keys.

Still further, the two keys can project from the body in the prelocking position, and two keys can be constructed so they do not project from the body in the locking position.

The connector can accordingly comprise a large number of passages in a relatively small space and the keys can have sufficient travel to lock the electrical contact members in small connectors.

The invention will now be described in more detail with reference to a specific embodiment shown by way of example only in the appended drawings.

DETAILED DESCRIPTION OF THE PREFERRED EMBODIMENT

Figure 1:
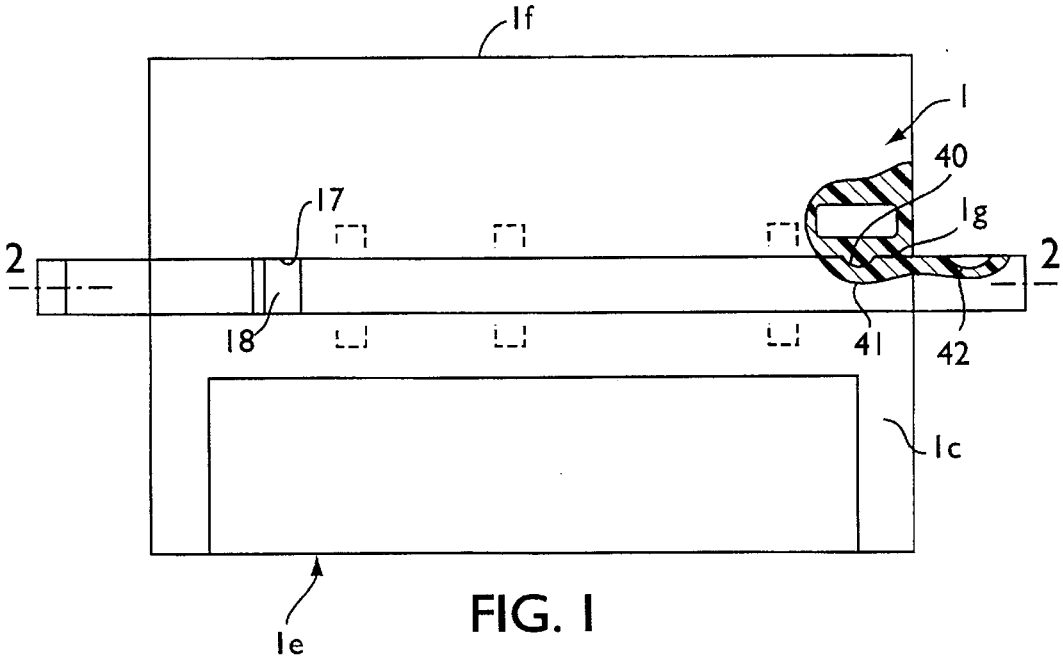
FIG. 1 is a top view of a housing element of the invention.

The housing element shown in the figures comprises a generally parallelepiped-shape insulative material body 1 having a top wall 1*c* and two end walls 1*e* and 1*f*. A series of passages 2 in the body have an insertion end 3 opening onto the wall 1*f* and an abutment 4 with an opening 5 in it that opens onto the wall 1*e*.

Each passage 2 is adapted to receive an electrical contact member 6. Each electrical contact member 6 comprises a body 7 which has at one end lugs 8 for crimping a conductor 13 and lugs 9 for gripping the insulative sheath of said conductor. The other end is shaped to constitute an elastic clamp 11 adapted to grip a male tongue of a complementary contact member.

The end of the member 6 adjacent the elastic clamp 11 is adapted to bear against the abutment 4 and the body 7 includes a locking tongue 14 adapted to cooperate with a shoulder 15 in the passages 2.

Each member 6 has a shoulder 16 which, when said members 6 are in place, is in line with an edge 17 of a groove 18, the other edge 19 of which is in line with pare of the body 6 linking the shoulder to the lugs 8.

The edge 17 is formed with two first series of ramps 20, 20*a*, 20*b* and 21, 21*a*, 21*b* and two second series of ramps 22, 22*a*, 22*b* and 23, 23*a*, 23*b*.

All the ramps are inclined in the same direction.

The edge 19 is formed with ramps corresponding to those of the edge 17.

A first key 30 is inserted into the groove 18 from one side of the body 1. The key is U-shape with two branches 31 and 32 and a core 33. The branch 31 has studs 36 on the faces that face towards the ramps 20, 20*a*, 20*b* adapted to cooperate with those ramps.

The branch 32 has studs 37 on the faces that face towards the edges 17 and 19. Said studs are engaged in the ramps 21, 21*a* and 21*b*.

A boss 40 with which recesses 41 and 42 in the branch 31 can selectively cooperate is provided on the edge 19 of the groove 18, near the side wall 1*a*.

A second key 44 is engaged in the groove 18 from the side wall 1*b* and is therefore in a head-to-tail arrangement relative to the first key, said second key 44 being U-shape with two branches 46 and 47 and a core 45. On its faces that face towards the edges 17 and 19 of the groove 18 the branch 46 has studs 48 engaged in the ramps 22, 22*a* and 22*b*. The corresponding faces of the branch 47 comprise studs 49 cooperating with the ramps 23, 23*a* and 23*b*.

On the edge 19 near the wall 1*b* the groove 18 has a boss 50 with which recesses 51 and 52 selectively cooperate.

Figure 4:
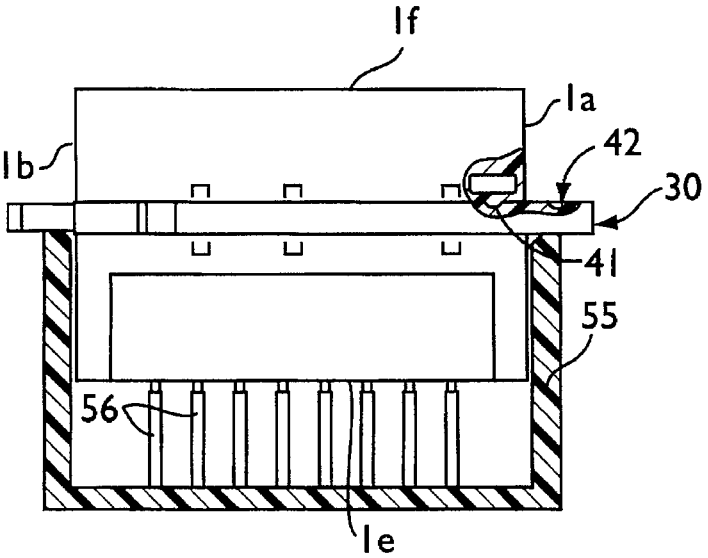
FIG. 4 is a sectioned view showing mounting of part of the housing element in a complementary housing element.

Referring to FIG. 4, the housing element of the invention constitutes a male element adapted to be inserted into a complementary female housing element 55 comprising a series of tongues 56 adapted to pass through the openings 5 and to be gripped in the clamps 11 of the members 6.

Figure 2:
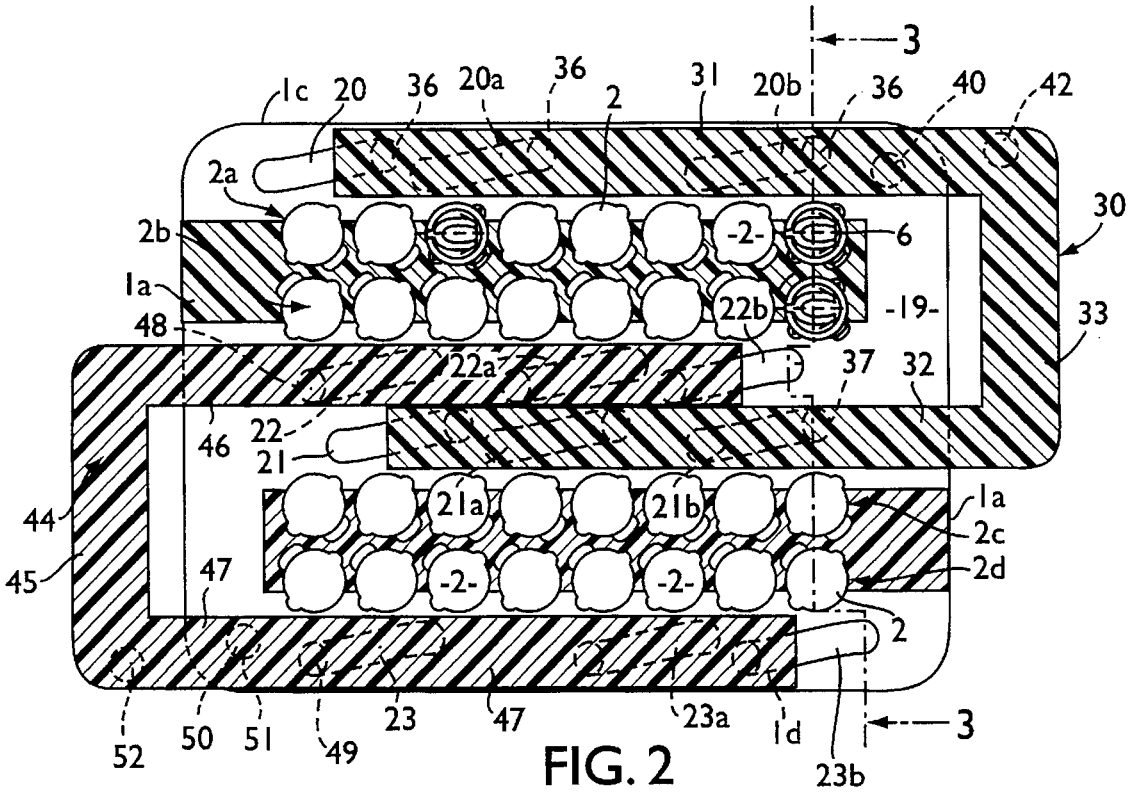
FIG. 2 is a view in section on the line 2—2 in FIG. 1.
Figure 3:
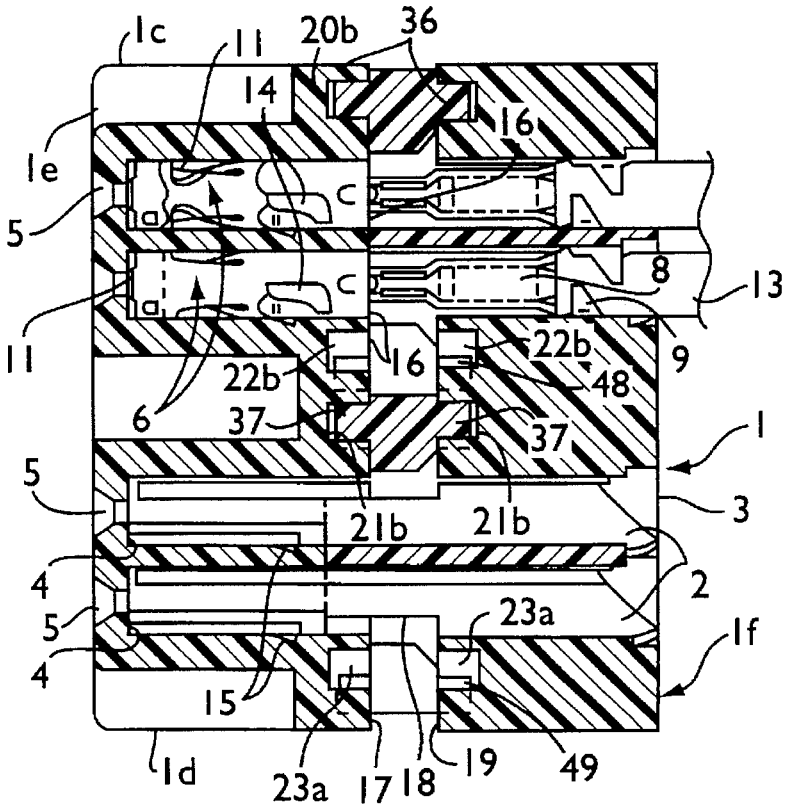
FIG. 3 is a view in section on the line 3—3 in FIG. 2.
Figure 5:
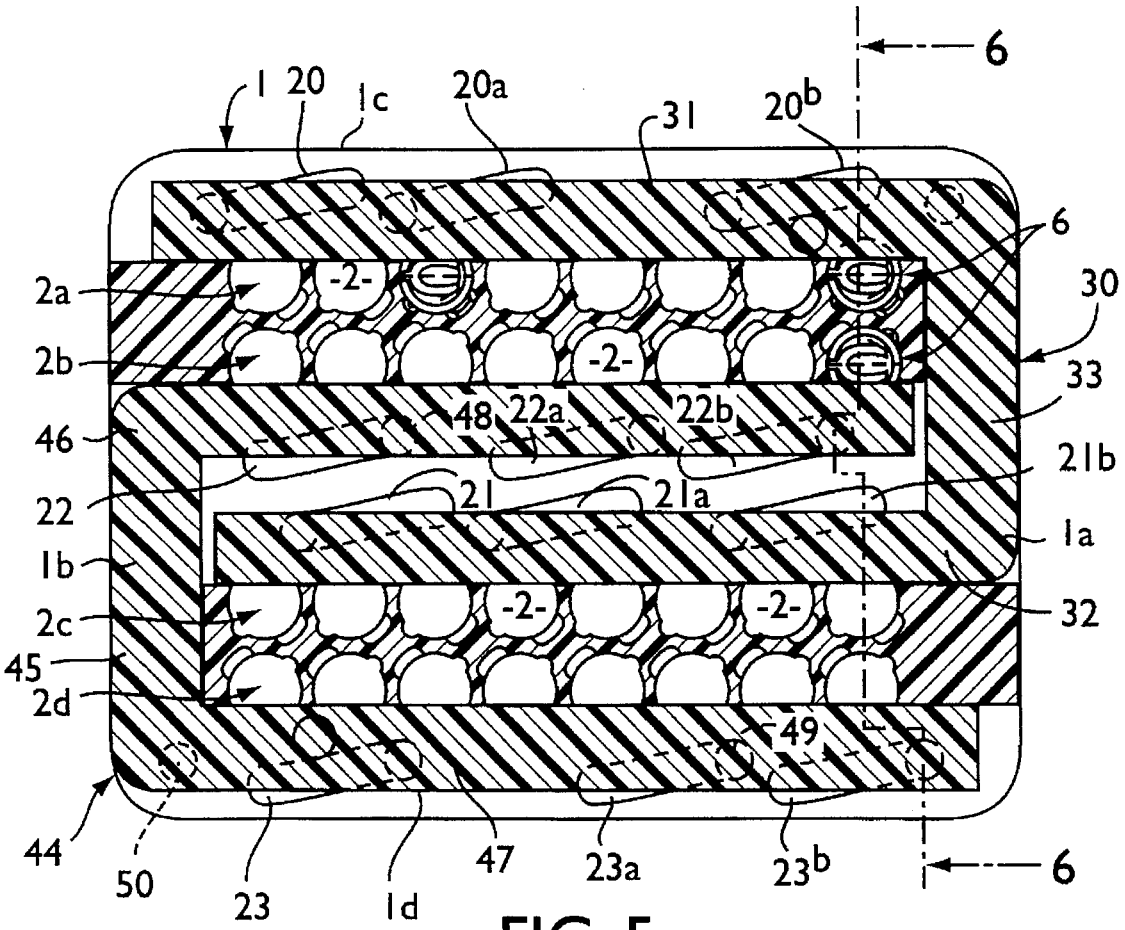
FIG. 5 is a sectioned view similar to that of FIG. 2 but with the keys locked.
Figure 7:
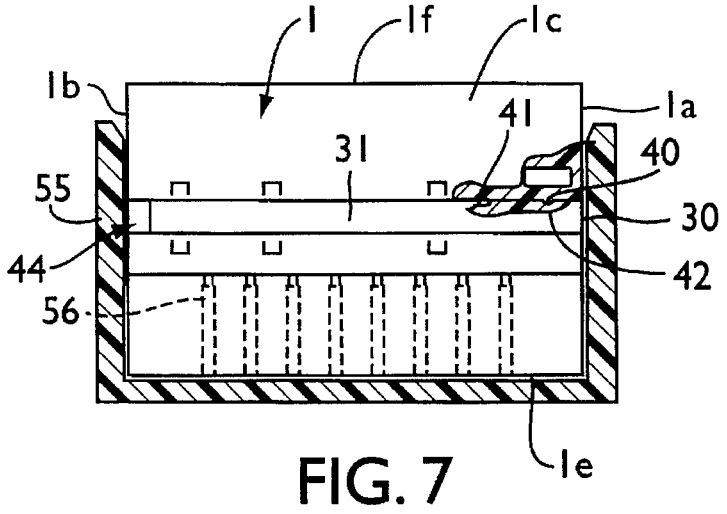
FIG. 7 is a sectioned view showing part of the element of the invention fixed into a complementary element.
Figure 6:
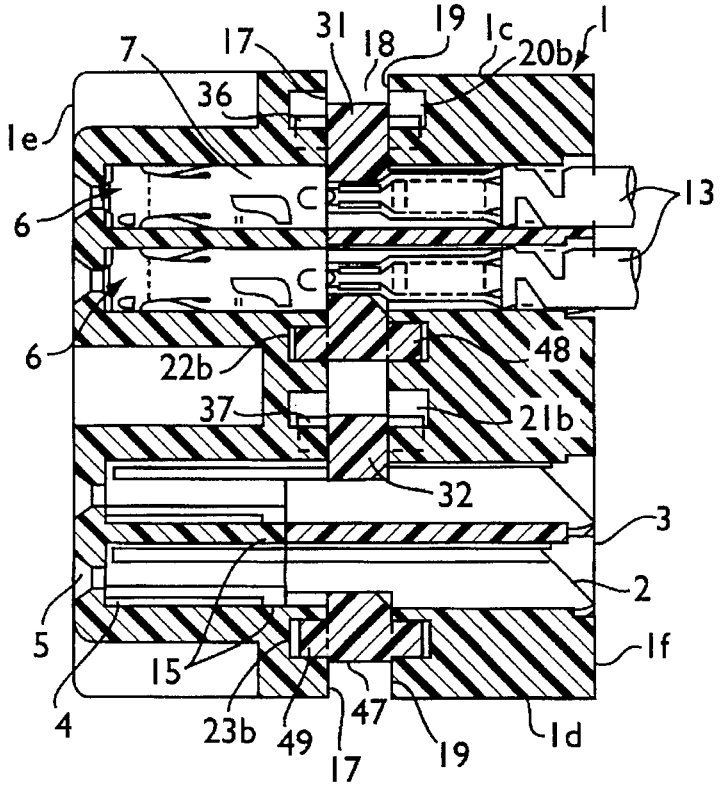
FIG. 6 is a view in section on the line 6—6 in FIG. 5.

The various ramps terminate at each end in right-angle faces, one corresponding to a prelocking position in which the keys 30 and 44 are moved away from the shoulder 16 to enable insertion of the members 6, the recesses 41 and 51 cooperating with the bosses 40 and 50, respectively (see FIG. 2), and the other corresponding to a locking position in which the keys cooperate with the shoulders 16, the recesses 42 and 52 receiving the bosses 40 and 50, respectively (see FIG. 5).

The housing element of the invention comprises a first series of passages with two parallel rows 2*a* and 2*b* and a second series of passages 2 with a first row 2*c* and a second row 2*d*. The first and second series of passages are separated by the part of the groove 18 containing the branches 32 and 46 of the keys 30 and 44.

In the prelocking position (see FIGS. 1, 2, 3 and 4) the cores 33 and 45 of the keys 30 and 44 project from the respective surface of the side walls 1*a* and 1*b* and the passages 2 are uncovered so that the members 6 can be inserted from the ends 3 and pushed in until they contact the abutments 4.

In this position of the members 6 the groove 18 is uncovered and the key 30 can be pushed into the position shown in FIG. 5 with the recess 42 over the boss 40. Accordingly the branch 31 retains all the members 6 of the first row of passages 2*a* and the branch 22 cooperates with the shoulders 16 of the member 6 of the first row 2*c* of the second series of passages.

The key 44 can be pushed in until its branch 46 faces the second row of the first series of passages 2*b* and its branch 47 faces the second row of the second series of passages 2*c*.

The shoulders 16 of the member 6 are therefore held and immobilized. In the locked position of the key 44 the recess 52 cooperates with the boss 50.

Figure 8:
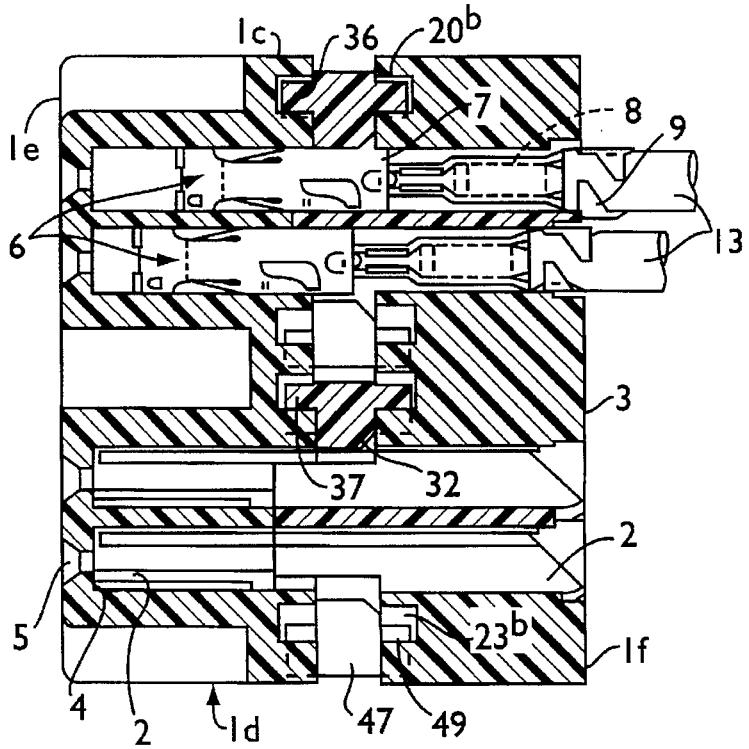
FIG. 8 is a sectioned view similar to those of FIGS. 3 and 6 showing that it is impossible to close the locking keys if the electrical contact members are not inserted properly.

As shown in FIG. 8, the keys 30 and 44 cannot move to the locking position if the members 6 are not inserted properly in the passages 2.

Also, if the keys 30 and 44 are not locked it is impossible to assemble the housing element 1 to the complementary housing element 55 since the keys then project from the surface of the side walls 1*a* and 1*b* (see FIG. 4).

Of course, the invention is not limited to the embodiment described and shown. Numerous modifications of detail can be made thereto without departing from the scope of the invention. A greater or smaller number of rows of passages could be provided, for example.

There is claimed:

1. Electrical connector housing element comprising:

an insulative material body having two series of passages, each of said two series of passages comprising two rows of passages including a first row and a second row, said passages comprising longitudinal axes which are positioned substantially parallel to each other, and each of said passages being adapted to receive an electrical contact member, each electrical contact member having a length and comprising a shoulder positioned partway along said length;

a groove in said body, said groove being perpendicular to said axes of said passages;

two U-shape keys including a first U-shape mobile key and a second U-shape mobile key, each of said two keys including two branches, said two keys being positioned and movable in said groove between a first prelocking position enabling insertion of electrical contact members into said passages, and a second locking position wherein said two keys cooperate with the shoulders of the electrical contact members to lock the electrical contact members in said passages, said two keys being positioned in a head-to-tail arrangement with each key being mounted so that one of the two branches of one of said two keys extends between the two branches of the other of said two keys, said first key being movable in two perpendicular directions with respect to said axes of said passages, said second key being movable in two perpendicular directions with respect to said axes of said passages, and said two perpendicular directions of movement of said second key are opposite to said two perpendicular directions of movement of said first key, said two branches of said first key, in said locking position, immobilizing the electrical contact members of the first rows of said two series of passages, and said two branches of said second key, in said locking position, immobilizing the electrical contact members of the second rows of said two series of passages.

2. The element according to claim 1, wherein said groove comprises two edges, inclined ramps positioned on said two edges, and each of said inclined ramps is inclined in the same direction; and studs on each of said two branches of said first key and said second key cooperating with said inclined ramps to effect movement in one of said two perpendicular directions as each of said two keys is moved in the other of said two perpendicular directions.

3. The element according to claim 2, wherein said two keys project from said body in said prelocking position, and said two keys do not project from said body in said locking position.

4. The element according to claim 1, including at least one boss and at least one recess for cooperating with said at least one boss in said locking position.

5. The element according to claim 4, wherein said at least one boss and said at least one recess are positioned on at least one of said two edges and on at least one of said two branches of said two keys.

6. The element according to claim 2, including at least one boss and at least one recess for cooperating with said at least one boss in said locking position.

7. The element according to claim 6, wherein said at least one boss and said at least one recess are positioned on at least one of said two edges and on at least one of said two branches of said two keys.

8. The element according to claim 6, wherein said two keys project from said body in said prelocking position, and said two keys do not project from said body in said locking position.

9. The element according to claim 1, wherein said two keys project from said body in said prelocking position.

10. The element according to claim 9, wherein said two keys do not project from said body in said locking position.

11. Electrical connector housing element comprising:

an insulative material body having passages, said passages comprising longitudinal axes which are positioned substantially parallel to each other, and each of said passages being adapted to receive an electrical contact member, each electrical contact member having a length and comprising a shoulder positioned partway along said length;

a groove in said body, said groove being perpendicular to said axes of said passages;

two U-shape keys including a first U-shape mobile key and a second U-shape mobile key, each of said two keys including two branches, said two keys being positioned and movable in said groove between a first prelocking position enabling insertion of electrical contact members into said passages, and a second locking position wherein said two keys cooperate with the shoulders of the electrical contact members to lock the electrical contact members in said passages, said two keys being positioned in a head-to-tail arrangement with each of said two keys being mounted so that one of the two branches of one of said two keys extends between the two branches of the other of said two keys, said first key being movable in two perpendicular directions with respect to said axes of said passages, said second key being movable in two perpendicular directions with respect to said axes of said passages, and said two perpendicular directions of movement of said second key are opposite to said two perpendicular directions of movement of said first key.

12. The element according to claim 11, wherein said groove comprises two edges, inclined ramps positioned on said two edges, and each of said inclined ramps is inclined in the same direction; and studs on each of said two branches of said first key and said second key cooperating with said inclined ramps to effect movement in one of said two perpendicular directions as each of said two keys is moved in the other of said two perpendicular directions.

13. The element according to claim 12, wherein said two keys project from said body in said prelocking position, and said two keys do not project from said body in said locking position.

14. The element according to claim 11, including at least one boss and at least one recess for cooperating with said at least one boss in said locking position.

15. The element according to claim 14, wherein said at least one boss and said at least one recess are positioned on at least one of said two edges and on at least one of said two branches of said two keys.

16. The element according to claim 12, including at least one boss and at least one recess for cooperating with said at least one boss in said locking position.

17. The element according to claim 16, wherein said at least one boss and said at least one recess are positioned on at least one of said two edges and on at least one of said two branches of said two keys.

18. The element according to claim 16, wherein said two keys project from said body in said prelocking position, and said two keys do not project from said body in said locking position.

19. The element according to claim 11, wherein said two keys project from said body in said prelocking position.

20. The element according to claim 19, wherein said two keys do not project from said body in said locking position.

* * * * *